US006224099B1

(12) United States Patent
Nielson et al.

(10) Patent No.: US 6,224,099 B1
(45) **Date of Patent: *May 1, 2001**

(54) SUPPLEMENTAL-RESTRAINT-SYSTEM GAS GENERATING DEVICE WITH WATER-SOLUBLE POLYMERIC BINDER

(75) Inventors: Daniel B. Nielson, Brigham City, UT (US); Gary K. Lund, Malad, ID (US); Reed J. Blau, Richmond, UT (US)

(73) Assignee: Cordant Technologies Inc.

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/119,517

(22) Filed: Jul. 21, 1998

Related U.S. Application Data

(60) Provisional application No. 60/053,368, filed on Jul. 22, 1997.

(51) Int. Cl.[7] ..... B60R 21/28; C06B 31/00; D03D 23/00

(52) U.S. Cl. ..... 280/741; 149/45; 149/108.6; 102/205

(58) Field of Search ..... 149/18, 19.7, 19.91, 149/108.6, 109.6, 45, 2, 17; 102/202.5, 202.7, 205, 202; 280/741

(56) References Cited

U.S. PATENT DOCUMENTS

| | | | |
|---|---|---|---|
| 2,416,639 | 2/1947 | Pearsall . | |
| 2,923,239 | 2/1960 | Andrew et al. . | |
| 3,062,147 | 11/1962 | Davis et al. | 102/70 |
| 3,257,801 | 6/1966 | Martinez et al. . | |
| 3,338,764 | 8/1967 | Evans . | |
| 3,407,731 | 10/1968 | Evans . | |
| 3,420,137 * | 1/1969 | Staba | 86/1 |
| 3,682,727 * | 8/1972 | Heinzelmann et al. | 149/19 |
| 3,682,729 | 8/1972 | Gukelberger, Jr. et al. . | |
| 3,745,927 * | 7/1973 | Tanner et al. | 102/103 |
| 3,841,929 * | 10/1974 | Craig | 149/17 |
| 3,899,973 | 8/1975 | Brocart | 102/27 R |
| 3,912,562 | 10/1975 | Garner . | |
| 3,986,908 | 10/1976 | Grebert et al. . | |
| 4,080,902 * | 3/1978 | Goddard et al. | 102/70 |
| 4,140,561 * | 2/1979 | Keith et al. | 149/2 |
| 4,220,087 | 9/1980 | Posson . | |
| 4,232,606 | 11/1980 | Yunan . | |
| 4,238,253 | 12/1980 | Garner . | |

(List continued on next page.)

FOREIGN PATENT DOCUMENTS

| | | |
|---|---|---|
| 240427 | 12/1945 | (CH) . |
| 32 43 425 | 5/1984 | (DE) . |
| 94 16 123 | 1/1995 | (DE) . |
| 0 310 580 | 4/1989 | (EP) . |
| 2015074 | 4/1970 | (FR) . |
| 2 235 348 | 1/1975 | (FR) . |
| 2 441 598 | 6/1980 | (FR) . |
| 1 231 181 | 5/1971 | (GB) . |
| WO 95/19944 | 7/1995 | (WO) . |
| WO 97/04860 | 2/1997 | (WO) . |

OTHER PUBLICATIONS

Pergamon Press, Edited by Alain Davenas, solid rocket propulsion technology, components of Solid Rockets, pp. 427–429.
Alain Davenas, pp. 354–358.

*Primary Examiner*—Michael J. Carone
*Assistant Examiner*—Aileen J. Baker

(57) ABSTRACT

The present invention relates to an igniter composition which is capable of being extruded to yield a robust igniter extrudate. The composition is particularly useful in the form of an igniter stick or other selected geometry for use in supplemental safety restraint systems designed for use such as in vehicles, ground or airborne, having such systems.

36 Claims, 1 Drawing Sheet

U.S. PATENT DOCUMENTS

| | | | | |
|---|---|---|---|---|
| 4,482,405 | * | 11/1984 | Wright | 149/19.3 |
| 4,493,261 | | 1/1985 | Simon et al. . | |
| 4,607,573 | | 8/1986 | Thureson et al. . | |
| 4,718,345 | | 1/1988 | Yunan . | |
| 4,798,142 | | 1/1989 | Canterberry et al. | 102/290 |
| 4,853,052 | | 8/1989 | Calsson et al. . | |
| 4,931,112 | | 6/1990 | Wardle et al. . | |
| 4,963,201 | * | 10/1990 | Bjerke et al. | 149/2 |
| 5,016,914 | | 5/1991 | Faigle et al. | 280/741 |
| 5,024,160 | | 6/1991 | Canterberry et al. | 102/323 |
| 5,062,365 | | 11/1991 | Canterberry et al. | 102/322 |
| 5,125,684 | | 6/1992 | Cartwright . | |
| 5,216,199 | * | 6/1993 | Bjerke et al. | 102/471 |
| 5,237,928 | * | 8/1993 | Redecker | 102/431 |
| 5,273,309 | | 12/1993 | Lau et al. | 280/730 A |
| 5,317,974 | | 6/1994 | Stewart et al. . | |
| 5,472,535 | | 12/1995 | Mendenhall et al. . | |
| 5,514,230 | | 5/1996 | Khandhadia . | |
| 5,516,377 | | 5/1996 | Highsmith et al. . | |
| 5,536,339 | | 7/1996 | Verneker . | |
| 5,540,154 | | 7/1996 | Wilcox et al. . | |
| 5,542,704 | | 8/1996 | Hamilton et al. . | |
| 5,597,973 | | 1/1997 | Gladden et al. . | |
| 5,610,364 | | 3/1997 | Endicott, Jr. et al. . | |
| 5,626,360 | * | 5/1997 | Lauritzen et al. | 280/741 |
| 5,668,345 | | 9/1997 | Schroeder et al. | 102/289 |
| 5,670,098 | | 9/1997 | Dillehay et al. . | |
| 5,670,735 | | 9/1997 | Ortmann et al. | 102/202 |
| 5,735,118 | * | 4/1998 | Hinshaw et al. | 60/219 |
| 5,763,818 | | 6/1998 | Guymon et al. . | |
| 5,837,924 | | 11/1998 | Austin . | |

* cited by examiner

SUPPLEMENTAL-RESTRAINT-SYSTEM GAS GENERATING DEVICE WITH WATER-SOLUBLE POLYMERIC BINDER

RELATED APPLICATIONS

This is a complete application of U.S. Provisional Application No. 60/053,368 filed Jul. 22, 1997, the complete disclosure of which is incorporated herein by reference.

BACKGROUND OF THE INVENTION

1. Field of the Invention

The present invention relates to extrudable igniter compositions, and specifically extruded ignition sticks, prills, pellets, and granules. More particularly, the present invention relates to providing sticks in combination with gas generant compositions suitable for use in gas bag inflators, such as supplemental safety restraint systems for vehicles, and related apparatus.

2. Background Information

Igniter compositions for supplemental safety systems, including "airbags," ought to satisfy a number of design criteria. The igniter composition, when formed, should be sufficiently robust to remain in operable form prior to deployment of a safety system, such as a passenger-protecting, driver-protecting, or side impact system. Consistent with the overall objectives of these and other types of safety systems, the igniter compositions are generally sought to be used in such amounts to avoid disposal problems and avoid generating by-products in amounts which pose other hazards following ignition.

Supplemental safety restraint systems have heretofore employed a number of different igniter systems. One of the commonly proposed igniter systems uses solid particles consisting of $B/KNO_3$ which, when ignited, initiate combustion of the specified gas generant composition.

Other recent efforts have focused on developing alternative cost-effective igniter compositions or igniter compositions which are more easily manufactured. These efforts have included a proposal to use a hot-melt thermoplastic resin matrix together with a particular igniter composition, such as $KNO_3$. This effort sought to marry a commercially available hot melt adhesive, such as one designed for so-called "glue-guns", with a common alkali metal oxidizer. This effort to improve performance was less than satisfactory. Extrudability and igniter performance proved difficult to control, and the repeatable ballistic performance desired for supplemental safety restraint systems has not yet been demonstrated.

Accordingly, despite these and still other efforts, commercially relevant objectives remain unattained. A simpler, more cost-effective igniter composition for supplemental safety restraint systems remains desired. In particular, efforts are still on-going towards providing an igniter composition which avoids the need for hot melting so-called adhesives, and thus the consequent risks associated with processing a pyrotechnic material at an elevated temperature, but which is facile to manufacture and would be sufficiently robust.

It would, therefore, be a significant advance to provide igniter compositions capable of being used to ignite gas generant compositions which satisfactorily address these concerns in the industry.

SUMMARY AND OBJECTS OF THE PRESENT INVENTION

The present invention offers an attractive commercially viable extrudable igniter composition which accomplishes the above and other objectives.

The present extrudable igniter composition is readily manufactured at low cost to obtain a physically robust product. The present composition can be manufactured without the use of a thermoplastic melt or hot-melt mixing equipment, and thus avoids the potential hazards associated with processing at such elevated temperatures. Furthermore, the igniter formulation is extended as a thick paste with water. The water alternates the hazards associated with processing igniter compositions. The extrudable igniter composition can be formed at ambient temperatures and, after post-drying, yields robust products which have relatively selectable ignition characteristics which are particularly desired for supplemental safety restraint systems and the like.

A solid or hollow igniter "stick" capable of igniting a gas generant composition in a gas generating device, such as an inflator in an airbag system can be fabricated from a present extrudable igniter composition. The igniter stick have other configurations such as pellets, prills or granules provided the configuration is consistent with the objectives herein disclosed.

Supplemental safety restraint systems incorporating these igniter sticks and vehicles equipped with such systems are also contemplated herein.

DETAILED DESCRIPTION OF THE INVENTION

Figure 1:
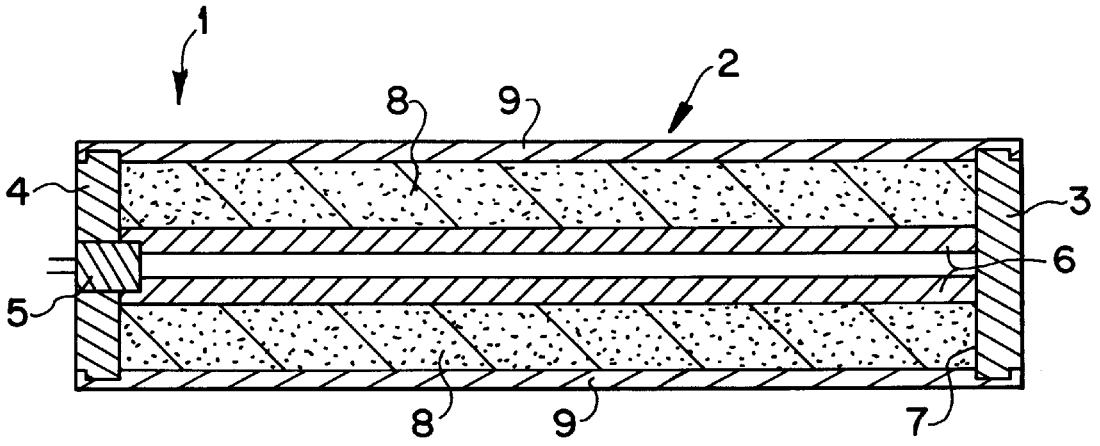
FIG. 1 illustrates an exemplary inflator device which includes an igniter stick formed from an extrudable igniter composition of the present invention.

The extruded igniter sticks can be characterized as having a configuration designed for rapid deflagration at a high temperature upon ignition. Upon ignition an igniter stick is capable of igniting another pyrotechnic composition. In driver or passenger side air bag systems, the igniter sticks are sized to be capable of complete end to end ignition, e.g., complete flame transition, in a short time, such as less than 10 milliseconds. In the form of pellets, prills or granules; the extendable igniter composition provides robust grains with a high packing density. This combination of qualities provides for a controlled, reproducible ignition. The duration of the ignition can be controlled by the grain size. In cases of certion formulations, sudden sharp ignition impulse flash is less effective in igniting the gas generant than a somewhat slower broad ignition impulse.

The igniter compositions which are capable of being extruded are characterized as being obtainable from a combination of a binder, water-soluble or dispersable oxidizing agent, water-soluble or dispersable fuel, and a selected amount of water. By preference, the extrudable compositions are essentially compositionally homogeneous.

The binder is, by present preference, a water-soluble binder, although water-swellable binder materials are not excluded provided that the remaining solid constituents of the igniter are at least substantially sufficiently homogeneously distributable therein. Typical binders used in the present igniter composition include, by way of example, water-soluble binders such as poly-N-vinyl pyrolidone, polyvinylalcohol and copolymers thereof, polyacrylamide, sodium polyacrylates, copolymers based on acrylamide or sodium acrylate, gums, and gelatin. These water soluble binders include naturally occurring gums, such as guar gum, acacia gum, modified celluloses and starches. A detailed discussion of "gums" is provided by C. L. Mantell, *The*

*Water-Soluble Gums,* Reinhold Publishing Corp., 1947, which is incorporated herein by reference. It is presently considered that the water-soluble binders allow efficient extrusion and improve mechanical properties or provide enhanced crush strength. Although water immiscible binders can be used in the present invention, it is currently preferred to use water soluble binders in combination with fuels and/or oxidizers suitable for use in formulating an igniter. The suitable fuels and oxidizers can be water soluble or water insoluble. Suitable fuels and oxidizers can be inorganic or organic.

In the formulation from which the extruded igniter stick, pellet, prill or granual is formed, the binder concentration is such that a sufficiently mechanically robust extrudate is obtained. The extrudate, such as an igniter stick, should be capable of retaining its shape, e.g. maintaining its integrity, prior to ignition. By preference, the extruded igniter stick is capable of being received in a pyrotechnic composition, e.g. a suitably configured bore (e.g. central bore) in a gas generant composition, and of shattering or fracturing when ignited. In contrast, the pellets, prills or granules will have sufficient strength to not pulverize during the process of becoming ignited. In general, the binder can be in a range of, for example, of about 2% by weight to about 10% by weight, and more particularly about 3% by weight to about 7% by weight, relative to the dry ingredients in the formulation. The binder can be comprised of more than one binder material.

The igniter composition includes at least one oxidizer, which is preferably water soluble or at least water dispersable. The oxidizer can therefore be organic or inorganic, although inorganic oxidizers are presently preferred. Organic oxidizers which are dispersable in a binder so that a sufficiently homogeneous igniter composition is obtainable include amine nitrate salts, nitro compounds, nitramine, nitrate esters, and amine perchlorates, of which methyl ammonium nitrate and methyl ammonium perchlorate are exemplary. Other candidates include RDX and HMX, CL-20 and PETN. Inorganic oxidizers include oxidizing ionic species such as nitrates, nitrites, chlorates, perchlorates, peroxides, and superoxides. Typifying these inorganic oxidizers are metal nitrates such as potassium nitrate or strontium nitrate, ammonium nitrate, metal perchlorates such as potassium perchlorate, and metal peroxides such as strontium peroxide. In general, the oxidizer is ordinarily present in an amount effective to ensure oxidation of at least the fuel in the igniter and can be in a range of, for example, of about 40% by weight to about 90% by weight, and more particularly about 70% by weight to about 85% by weight, relative to the dry ingredients in the formulation.

The igniter composition can be formulated with an additional fuel, assuming that the binder may be capable of functioning as a secondary, not primary, fuel for the igniter composition. These additional fuels include powdered metals, such as powdered aluminum, zirconium, magnesium and/or titanium, among others; metal alloys such as 70%:30% aluminum/magnesium alloy; metal hydrides such as zirconium or titanium hydride; and so-called metalloids, such as silicon and boron which are capable of being sufficiently "dispersable" in the binder. Water-soluble or water-dispersable fuels include, e.g., guanidine nitrate, hexa ammine cobalt nitrate and relaed colbalt (III) complexes, cyano compounds, nitramines (RDX and/or HMX), CL-20, tetranitrocarbazoles, organic nitro compounds, and may, if desired, be "multi-modal" in particle size distribution. Water dispersable materials can be added in substantially even particle size distribution or in multi-modal distributions depending on the ignition characteristics desired.

Water dispersable fuels are, by present preference, used in fine particulate form, such as powder or ground to sufficient fine particles, to ensure adequate distribution during the manufacturing process. By preference, an at least substantially even distribution in the resultant extrudable igniter composition is desired. In general, the fuel is in pulverulent form, such as 100$\mu$ or less, such as, for example, from about 1$\mu$ to 30$\mu$. Metals in powder form may be used and may have, if desired, a smaller particle size range, such as from about 1 to 20$\mu$, or even smaller such as 1 to about 5$\mu$. The amount of fuel—other than the binder—can be in a range of, for example, about 5 to about 40% by weight, and more particularly about 10% by weight to about 20% by weight, relative to the dry ingredients in the formulation.

The present igniter sticks and related grains can incorporate, if desired, a reinforcement. Suitable reinforcement can be achieved with fibers, such as combustible fibers, which can serve to both strengthen the extruded igniter stick, and, upon appropriate selection of the reinforcement, improve igniter performance. The fibers are preferably generally shorter in length (low aspect ratio). Fibers incorporated into extrudable igniter formulations include, for instance, polyolefin fibers, polyamide fibers, polyester fibers and poly (2,2'-(m-phenylene)-5,5-bisbenzimidazole ("PBI") fibers. Polyolefin fibers include polyethylene ("PE") fibers, such as PE fibers having an outer diameter of about 0.005 mm and higher, such as to about 0.8 mm, and a length in a range of 0.1 mm to about 3.2 mm, of which the Spectra 900 brand of polyethylene fiber from Allied-Signal is illustrative. Suitable polyamide fibers, such as Nylon 6 fibers, can have a suitably selected diameter, such as 19 microns, and a length of 1.5 mm to about 6.4 mm. Suitable polyester fibers include high tenacity polyester fibers having lengths of about 1.5 mm to about 6.4 mm, and a suitable diameter of about 25 microns. PBI fibers include those having lengths on the order of 0.8 mm to 3.2 mm. Representative reinforced igniter sticks and the formulations therefor are reported in the Examples.

The present composition in extrudable form is readily obtainable, for instance, by mixing binder, fuel, oxidizer and the selected amount of water for such a period of time to achieve an at least substantially even distribution of the fuel, if used, and oxidizer throughout the binder. One method involves dry blending a water-soluble binder and the oxidizer followed by adding a selected amount of water and mixing until homogeneous to form a pre-mix, and admixing the pre-mix incrementally with portions of the fuel(s) one to three increments. The amount of water is generally such that the resultant product has a consistency which is extrudable, but, by preference, is not runny. If too much water is present, the grain will tend to sag and otherwise not maintain its shape after extrusion.

The igniter composition thus formed is capable of being extruded to the desired physical geometry.

The extruded igniter composition is preferably not foamed, i.e., a solid.

The igniter compositions which are capable of being extruded are readily adapted for use in igniter systems for use in combination with airbag inflator technology. The systems can include one or more igniter sticks or, in the case of pellets, prills or granules, a whole multitude. Airbag inflator technology includes automotive (vehicular) airbag systems, hybrid inflator technology, and, for example, side impact systems. Vehicular, e.g. automotive, truck, or the like, inflatable safety restraint systems are disclosed in U.S. Pat. Nos. 5,536,339, 5,542,704 and 5,668,345 among others, the complete disclosures of which are incorporated herein by reference. Systems related to airbag inflation or the like, are disclosed in U.S. Pat. No. 5,441,303, the complete disclosure of which is hereby incorporated by reference.

An automobile airbag system can comprise a collapsed, inflatable airbag; a gas-generating device connected to the airbag for inflating the airbag, the gas-generating device containing a gas-generating composition which generates gases suitable for use in an automobile airbag system; and an ignition system for igniting the gas-generating composition which includes igniter stick(s) or pellets, prills or granules based on the present igniter composition and also on the specifications of the gas-generating device. The ignition system can also include a squib.

Hybrid inflator technology is based on heating a stored inert gas (argon or helium) to a desired temperature by burning a small amount of propellant. Hybrid inflators do not require cooling filters used with pyrotechnic inflators to cool combustion gases, because hybrid inflators are able to provide a lower temperature gas. The gas discharge temperature can be selectively changed by adjusting the ratio of inert gas weight to propellant weight. The higher the gas weight to propellant weight ratio, the cooler the gas discharge temperature. A hybrid gas generating system can comprise a pressure tank having a rupturable opening, a pre-determined amount of inert gas disposed within that pressure tank; a gas generating device for producing hot combustion gases and having means for rupturing the rupturable opening; and means for igniting the gas generating composition which incorporates the present igniter composition. The tank has a rupturable opening which can be broken by a piston when the gas generating device is ignited. The gas generating device is configured and positioned relative to the pressure tank so that hot combustion gases are mixed with and heat the inert gas. Suitable inert gases include, among others, argon, helium and mixtures thereof. The mixed and heated gases exit the pressure tank through the opening and ultimately exit the hybrid inflator and deploy an inflatable bag or balloon, such as an automobile airbag. Hybrid gas generating devices for supplemental safety restraint application are described in Frantom, Hybrid Airbag Inflator Technology, *Airbag Int'l Symposium on Sophisticated Car Occupant Safety Systems,* (Weinbrenner-Saal, Germany, Nov. 2–3, 1992).

Suitable restraint systems also include side impact systems. An airbag assembly for side impact, including the inflator and the collapsed, inflatable, and stored airbag can be mounted in a vehicle, such as an automobile, or truck, adjacent the release seat back, such as a front seat back. These airbag assemblies can include an airbag which deploys forwardly for front seat occupants or rearwardly for the rear seat occupant or airbags for both front and rear occupants. These airbag assemblies can be inflated with a single or separate gas generating devices sometimes called inflators in vehicular applications. A sensor device can, in general, be mounted in a door sill, or other desired location to provide an impact signal, such as to an electrical circuit, to activate deployment of the airbags. An exemplary suitable side impact airbag assembly is disclosed in U.S. Pat. No. 5,273,308, the complete disclosure of which is incorporated herein by reference.

A vehicle, air or land, equipped with any airbag system (such as a supplemental and/or side impact restraint system) which includes an igniter system including the present igniter stick or other type of grain is also part of our invention. For example, the vehicle can contain a supplemental restraint system having an airbag system comprising a collapsed, inflatable airbag; a gas-generating device connected to the airbag for inflating the airbag, the gas-generating device containing a gas-generating composition which is suitable for use in a vehicle (such as an automobile etc,) airbag system; and an igniter system for the gas-generating composition, which igniter system can be or include an igniter composition (in stick or other form such as "tape-like" or cylindrically shaped pellets, prills or granule) based on the present igniter composition. The supplemental safety system can, of course, be based on other airbag technology, including the hybrid airbag technology and/or side impact system.

Suitable solid gas generant compositions include the azide-based gas generants, and so-called non-azide compositions which are based on a non-azide fuel and an appropriate oxidizer. An example of the latter improved gas generant composition uses a bitetrazoleamine, or a salt or a complex thereof as a non-azide fuel, such as bis-(1(2)H-tetrazol-5-yl)-amine, which has been found to be particularly suitable for use in the gas generating compositions. Suitable such compositions are disclosed in U.S. Pat. No. 5,682,014, the complete disclosure of which is incorporated herein by reference.

Another gas generant composition comprises at least one complex of a metal cation, such as an alkaline earth or transition metal cation, and at least one neutral ligand which is comprised by nitrogen and hydrogen, such as ammonia or hydrazine(s), and sufficient oxidizing anion to balance the charge of the metal cation.

In general, the selected gas generant fuel is combined, in a fuel-effective amount, with an appropriate oxidizing agent to obtain a suitable gas generating composition. With fuel-effective amounts of a suitable fuel, the combustion products of a gas generant composition can be relatively balanced, that is the combustion products do not have excessive amounts of under or over oxidized species. Stoichiometric combustion is generally a desired objective.

Inorganic oxidizing agents are generally preferred because they produce a lower flame temperature and an improved filterable slag. Such oxidizers include metal oxides and metal hydroxides. Other oxidizers include a metal nitrate, a metal nitrite, a metal chlorate, a metal perchlorate, a metal peroxide, ammonium nitrate, ammonium perchlorate and the like. The use of metal oxides or hydroxy nitrates or hydroxides as oxidizers is particularly useful and such materials include, for instance, the oxides, hydroxides and hydroxy nitrates of copper, cobalt, manganese, tungsten, bismuth, molybdenum, and iron, such as $CuO$, $Cu_2(OH)_3NO_3$, $Co_2O_4$, $Fe_2O_3$, $MoO_3$, $Bi_2MoO_6$, $Bi_2O_3$, and $Cu(OH)_2$. The oxide and hydroxide oxidizing agents mentioned above can, if desired, be combined with other conventional oxidizers such as $Sr(NO_3)_2$, $NH_4ClO_4$ and $KNO_3$, for a particular application, such as, for instance, to provide increased flame temperature or to modify the gas product yields.

The selected gas generant fuel can, if desired, be combined with a relatively cool burning compound, which itself may be a fuel and/or oxidizer. In these compositions, another separate secondary oxidizer may, if desired, be dispensed with. Exemplary relatively cool burning compounds include guanidine nitrate, triamino guanidine nitrate, aminoguanadine nitrate, and urea, among others. For instance, a suitable gas generant composition can comprise a fuel, such as BTA and/or a metal ammine-containing complex or compound, and guanidine nitrate. Such compositions can, if desired, include a suitable binder, which may be the same or different from the binder used in preparing the igniter stick. These compositions can be formulated to include other additives known for inclusion in gas generant compositions.

The gas generant compositions which can be used in combination with an igniter stick or other ignition grain can also include additives conventionally used in gas generating compositions, propellants, and explosives, such as binders, bum rate modifiers, slag formers, chelating agents, release agents, and additives which effectively remove $NO_x$. Typical bum rate modifiers include $Fe_2O_3$, $K_2B_{12}H_{12}$, $Bi_2MoO_6$, and graphite carbon fibers. A number of slag forming agents are known and include, for example, clays, talcs, silicon oxides, and alkaline earth oxides, hydroxides and oxalates, of which magnesium carbonate, and magnesium hydroxide are exemplary. A number of additives and/or agents are also known to reduce or eliminate the oxides of nitrogen from the combustion products of a gas generant composition, including alkali metal salts and complexes of tetrazoles, aminotetrazoles, triazoles and related nitrogen heterocycles of which potassium aminotetrazole, sodium carbonate and potassium carbonate are exemplary. The composition can also include materials which facilitate the release of the composition from a mold such as graphite, molybdenum sulfide, or boron nitride.

Suitable gas generant compositions can also contain at least one binder. Exemplary binders are disclosed in U.S. application Ser. No. 08/507,552, of Hinshaw et al., filed Jul. 26, 1995, the complete disclosure of which is incorporated herein by reference. Typical binders include lactose, boric acid, silicates including magnesium silicate, polypropylene carbonate, polyethylene glycol, and polymeric binders, including water soluble polymers such as polyacrylamides. For instance, a suitable binder can comprise, for instance, a water soluble binder such as at least one water-soluble polymer or at least one naturally occurring gum, guar gum or acacia gum. For instance, a binder can be used in an amount of 0.5 to 12% by weight of the gas generant composition, and more preferably 2 to 8% by weight of the composition.

Gas generant compositions useful herein can also be formulated with crush strength enhancing agents (other than or in addition to a binder). Suitable such agents are generally solids in powdered form. For instance, a small but effective amount of carbon powder can be used in formulating a gas generant composition whereby the crush strength of the composition is capable of being increased compared to the composition without the carbon powder. The amount of crush strength enhancing agent can usually be up to 6 wt. % of the gas generant composition, although smaller amounts up to about 3 wt. % can also be used. An exemplary but particularly useful gas generant composition comprises hexaammine cobalt(III) nitrate; at least one water-soluble binder; optionally, carbon powder in an amount of about 0.1 to about 6% by weight of the composition; and optionally, at least one organic and/or inorganic co-oxidizer, such as guanidine nitrate or copper hydroxy nitrate respectively.

A co-oxidizer and/or co-fuel component (singly or as a mixture of co-oxidizers or co-fuels, respectively) can be included in a gas generant composition in an amount suited to achieve the desired combustion products. Generally, such amounts are less than about 50% by weight of the gas generant composition.

In short, a diverse number of gas generant compositions are suitable for use in combination with an igniter system which is based in whole or in part on an igniter stick or other grain according to the present invention. Suitable gas generant compositions include those described in U.S. Pat. Nos. 3,911,562, 4,238,253, 4,931,102, 5,125,684, 5,197,758, 5,429,691, 5,439,537, 5,472,647, 5,500,059, 5,501,823, 5,516,377, 5,536,339, 5,592,812, 5,608,183, 5,673,935, 5,682,014, and in U.S. application Ser. Nos. 08/507,552, filed Jul. 16, 1995, 08/162,596, filed Dec. 3, 1993, and U.S. Provisional Appln. No. 60/022645, filed Jul. 25, 1996, the complete disclosures of which are hereby incorporated by reference.

FIG. 1 illustrates a gas generating device 1. In the longitudinal cross section view, the casing 2 is a suitable pressure enclosure fabricated from steel or other material capable of being used for a gas generant application, such as airbags, have an end defined by or closed by the first end piece 3. The casing will be provided with a way for gas generated to be released, such as through openings in the case side walls. The second end piece 4 is installed at the opposite end from end piece 3. The casing 2 and end pieces 3 and 4 define an enclosure. End piece 4 is fitted with an igniter squib 5. The casing can, if desired, be fabricated to have less pieces to reduce the cost of manufacture. In a preferred embodiment, a solidified ignition stick, which may be solid or hollow, axially extends lengthwise from squib 5 through the interior of gas generating device towards the interior side 7 of end piece 3. The igniter stick 6 can be formed by extruding the hereinabove described extrudable igniter composition and allowing the extrudate to solidify. A selected gas generating composition 8 surrounds the igniter stick. A so-called rapid deflagration cord, if desired, can be disposed lengthwise, e.g., such as loosely sleeved, within a hollow igniter stick. More than one igniter stick can, if desired, be used.

Alternatively, the igniter can be in the formed of discrete prills disposed adjacent the iginter squib 5 but between the igniter squib 5 and the gas generating composition.

As illustrated, the gas generating device can, if desired, include one or more filter elements 9. The layout, geometry and location of a filter element will be selected based on the overall design of a particular gas generating device.

Although a gas generating device has been illustrated, other designs are included within the scope of the invention.

In another embodiment, the gas generating device can be connected to a collapsed but inflatable balloon, or air bag in a saftey restraint system.

The invention is further described with reference to the following non-limiting Examples.

EXAMPLES

Example 1

To a one gallon Baker-Perkins planetary mixer, 1170 g (78%) of 35 micron potassium nitrate and 105 g (7%) of Cytec Cyanamer® N-300 Polyacrylamide (15 million MW) were added. These ingredients were then blended remotely in the dry state for one minute. To this blend, 217.5 g (14.5 parts per 100 of igniter formulation) of water were added and mixed for five minutes. The mix blades and inner surface of the mix bowl were scraped with Velostat (conductive plastic) spatulas followed by 15 additional minutes of mixing. To the resulting thick white paste, 225 g (15%) of amorphous boron powder (90–92% purity) were added and mixed remotely for five minutes. The blades and bowl were again "scraped down" and the formulation was mixed for ten additional minutes. The resulting brown, dough-like material was granulated to −4 mesh and fed into a Haake 25 mm single-screw extruder. The igniter formulation was extruded through a 12 point star die with a maximum diameter of 0.33" and a minimum diameter of 0.30". The die included a central 0.080" diameter pin, thus producing a hollow rod-like configuration. The extruded igniter formulation was cut into 7" lengths. Before drying, a 7.5" length of 0.07" diameter. Teledyne RDC (rapidly deflagrating cord) was inserted into the 0.08" diameter perforation. The igniter sticks were dried at 165° F. overnight. The center igniter sticks were tested to evaluate their performance as an igniter in an inflator which was designed for passenger side automotive safety bags. The igniter sticks performed satisfactorily.

Example 2

A series of extruded igniter stick formulations containing boron, potassium nitrate, a water-soluble binder, and optionally, fibers for reinforcement were prepared. These formulations are reported in Table I. The formulations were first mixed on a 10 g and then a 30 g scale to determine their sensitivity towards stimuli including impact, friction, electrostatic discharge, and heat (Table II). In general, carbohydrate-based binders exhibited the greatest sensitivity with respect to friction. Formulations containing methyl cellulose, guar gum, and locust bean gum as the binder were also used to prepare igniter sticks.

The remaining formulations were mixed on a 325 g scale in a one pint Baker-Perkins planetary mixer. Potassium nitrate and the respective water-soluble binder were blended remotely in the dry state for one minute. To this blend, the respective amount of water (Table III) was added and the slurry was mixed for five minutes. As in Example 1, the bowl and blades were "scraped down". At this point, fibers were added to fiber-containing formulations and the dough was mixed for an additional 5 minutes. All formulations were mixed for 10 additional minutes before adding boron. One-half of the boron was added at this point followed by five minutes of mixing. The rest of the boron was then added followed by an additional five minutes of mixing. After a final "scrape down", the formulation was mixed for an additional ten minutes. The resulting brown, dough-like material was granulated to −4 mesh and fed into a Haake 25 mm single-screw extruder. The igniter formulation was extruded through a 12 point star die with a maximum diameter of 0.33" and a minimum diameter of 0.305". The die included a centrally located 0.80" diameter pin. The extruded igniter formulation was cut into 7" lengths. Before drying, a 7.5" length of 0.07" diameter Teledyne RDC (rapidly deflagrating cord) was inserted. Ten additional 2" lengths were extruded. The igniter sticks were dried at 165 F overnight.

Important factors in determining useful formulation include quality of the grain after drying, actual performance as an igniter, and drying rate. Leaching of a mixture of $KNO_3$ and binder to the surface of the grain may occur for some formulations during drying. Leaching in the perforation is not desired. Leaching was found to be least important in formulations containing tragacanth gum, Cyanamer® A-370 and Cyanamer® P-21 (Table III). Igniter sticks from the formulations containing Cyanamer® A-370 and Cyanamer® P-21 were evaluated using an inflator device. Relative drying rates of 10:1.7:1 were calculated for formulations containing Cyanamer® N-300, Cyanamer® P-21 and Cyanamer® A-370, respectively. Thus, the formulation containing Cyanamer® A-370 was shown to dry quickly, with minimal $KNO_3$ leaching producing a grain that ignites gas generant with minimal ignition delays.

It is important to develop an extruded igniter stick for automotive air bag systems that will withstand decades of jolts and vibrations due to automobiles driving into potholes, over rough roads, etc. Thus, a durability test method was developed for the extruded igniter sticks. Durability tests were performed in 3-point bending, with the load applied at mid-span. Bending was selected since tensile, compressive, and shear stresses are all present. Also, the sample configuration lends itself to this type of loading. A span of 1.5 inches was used, with the loads applied using ⅛- to ¼-inch diameter dowel pins. A nominal pre-load of 0.7 pounds was applied. The sample was then subjected to 1,000 loading cycles with the following conditions: cyclic amplitude 0.003 inch, frequency 10 Hertz. Afterthe cyclic loading, the samples were tested to failure at a displacement rate of 0.2 inches per minute. The durability of each sample is reported as the area under the load-displacement curve. For simplicity, the units are maintained as calibrated (load in pounds-force, displacement in milli-inches). Therefore, the reported durability has units of milli-inch-pounds. All testing was performed at lab ambient temperature (75°±5° F.). Durability test results indicated enhanced durability of extruded igniter formulations containing fibers, e.g., formulation #13 and #15 in Table III.

TABLE I

Examples of Igniter Formulations Designed for Extrusion with Water.

| Form. # | % KNO3 | % Boron | Binder | % Binder | Fiber | % Fiber |
|---|---|---|---|---|---|---|
| 1 | 78.00 | 15.00 | Cyanamer ® N-300[1] | 7.00 | none | 0.00 |
| 2 | 77.50 | 15.50 | Methyl Cellulose | 7.00 | none | 0.00 |
| 3 | 76.30 | 16.70 | Cyanamer ® A-370 | 7.00 | none | 0.00 |
| 4 | 77.80 | 15.20 | Cyanamer ® P-21 | 7.00 | none | 0.00 |
| 5 | 78.00 | 15.00 | Cyanamer ® N-300LMW | 7.00 | none | 0.00 |
| 6 | 76.50 | 16.50 | Tragacanth Gum | 7.00 | none | 0.Q0 |
| 7 | 76.50 | 16.50 | Locust Bean Gum | 7.00 | none | 0.00 |
| 8 | 76.50 | 16.50 | Karaya Gum | 7.00 | none | 0.00 |
| 9 | 78.00 | 15.00 | PAM l0000MW | 7.00 | none | 0.00 |
| 10 | 76.50 | 16.50 | Guar Gum, FG-l, H. V. | 7.00 | none | 0.00 |
| 11 | 77.00 | 16.00 | Gelatin, Bovine Skin | 7 | none | 0.00 |
| 12 | 78.50 | 12.50 | Cyanamer ® N-300 | 7.00 | C Fiber, | 2.00 |
| 13 | 78.50 | 12.50 | Cyanamer ® N-300 | 7.00 | C Fiber, | 2.00 |
| 14 | 78.50 | 12.50 | Cyanamer ® N-300 | 7.00 | SiC | 2.00 |
| 15 | 75.70 | 14.50 | Cyanamer ® N-300 | 6.80 | Saffil ®, Type | 2.00 |

[1]Cyanamer is a registered trademark of Cytec Industries Inc. for specialty polymers of polyacrylamide, sodium polyacrylate or copolymers thereof.
Cyanamer N-300: Polyacrylamide of ca. 15 M molecular weight
Cyanamer N-300 LMW: Polyacrylamide of ca. 5 M molecular weight
Cyanamer A-370: Copolymer of acrylamide and sodium acrylate, ca 10:90 by wt., 200,000 Mw
Cyanamer P-21: Copolymer of accylamide and sodium acrylate, ca 90:10 by wt., 200,000 Mw

TABLE II

Safety Characteristics of Extruded Igniter Formulations

| Form. | Binder | Fiber | ABL | ABL Sliding |
|---|---|---|---|---|
| 1 | Cyanamer ® N-300 | none | 80 GL | 800 @ 8 ft/s GL |
| 2 | Methyl Cellulose | none | 6.9 GL | 240 @ 6 ft/s YL |
| 3 | Cyanamer ® A-370 | none | 21 GL | 800 @ 8 ft/s GL |
| 4 | Cyanamer ® P-21 | none | 21 GL | 800 @ 8 ft/s GL |
| 6 | Tragacanth Gum | none | 21 GL | 320 @ 8 ft/s GL |
| 7 | Locust Bean Gum | none | 13 GL | 180 @ 6 ft/s YL |
| 8 | Karaya Gum | none | 21 GL | 240 @ 8 ft/s GL |
| 9 | PAM 10000MW | none | 41 GL | 800 @ 8 ft/s GL |
| 10 | Guar Gum, FG-1 | none | 11 GL | 100 @ 6 ft/s YL |
| 11 | Gelatin, Bovine | none | 33 GL | 800 @ 8 ft/s GL |
| 12 | Cyanamer ® N-300 | C Fiber, Fortafil ® F5C | 33 GL | 800 @ 8 ft/s GL |
| 13 | Cyanamer ® N-300 | C Fiber, Pyrograph ™ III | 41 GL | 800 @ 8 ft/s GL |
| 14 | Cyanamer ® N-300 | SiC Whiskers, Silar ® | 41 GL | 800 @ 8 ft/s GL |
| 15 | Cyanamer ® N-300 | Saffil ®, Type 590 | 51 GL | 420 @ 8 ft/s GL |

[1]Units are in centimeters.
[2]Units are in pounds.

TABLE III

Test Result Summary for Extruded Igniters.

| Form. | Binder | Fiber | Water[1] | Failure[2] | % Block-age[3] |
|---|---|---|---|---|---|
| 1 | Cyanamer ® N-300 | none | 14.5 | 55 | 100 |
| 3 | Cyanamer ® A-370 | none | 12.5 | 40 | 9 |
| 4 | Cyanamer ® P-21 | none | 11.5 | 34 | 45 |
| 5 | Cyanamer N-300LMW | none | 14.5 | 69 | 100 |
| 6 | Tragacanth Gum | none | 19 | 32 | 33 |
| 8 | Karaya Gum | none | 14.5 | 25 | 100 |
| 9 | PAM 10000MW[4] | none | 14 | NA | NA |
| 11 | Gelatin, Bovine Skin | none | 10.5 | 44 | 100 |
| 12 | Cyanamer ® N-300 | C Fiber, | 16.5 | 69 | 100 |
| 13 | Cyanamer ® N-300 | C Fiber, | 16.5 | 97 | 83 |
| 14 | Cyanamer ® N-300 | SiC | 17.5 | 51 | 100 |
| 15 | Cyanamer ® N-300 | Saffil ®, Type | 15.5 | 94 | 100 |

[1]The parts per 100 of water added to the formulation necessary to allow efficient single-screw extrusion.
[2]Average load at Failure of 2" sticks in durability tests. Units are in milli-inch-pounds.
[3]The percentage of blocked perforations was determined from six or more 0.33" OD, 0.08" ID, 2" L igniter sticks.
[4]Formulation No. 9 did not extrude very well.

Example 3

A series of igniters containing fibers were formulated with the goal of enhancing durability of the extruded igniter sticks as seen from Table IV. All formulations exhibited favorable safety characteristics. Samples (325 g) of each formulation were mixed in a Baker-Perkins pint mixer with 13.5 parts/100 of water. After dry blending the $KNO_3$ and Cyanamer® A-370 for one minute, the water was added followed by five minutes of mixing. The fiber was then added in two increments and the boron in three increments with three minutes of mixing after each addition. After a final "scrape down", the formulation was mixed for an additional ten minutes. The resulting brown, dough-like material was granulated to −4 mesh and fed into a Haake 25 mm single-screw extruder. The igniter formulation was extruded through a 12 point star die with a maximum diameter of 0.33" and a minimum diameter of 0.305". The die included a centrally located 0.15" diameter pin. The extruded igniter formulation was cut into 7" lengths. Ten additional 2" lengths were extruded. The igniter sticks were dried at 165 F overnight.

There were no signs of $KNO_3$/binder leaching outside of the igniter grains after drying. Grains were ignited with the ignition plume of an ES013 squib directed into the 0.15" ID perforation in the grain. The igniter grain was held in a 0.4" ID, 0.49" wall, cylindrical fixture with approximately 95 evenly distributed 0.109" ID holes drilled along its length and diameter. The times required for the flame front to reach the opposite end of the grain after ignition by the squib are reported in Table V. The times were determined from 1000 frames/second video. Generally, only a few milliseconds were required. Durability of 2" long grains was determined as described in Example 2. The results are reported in Table V. By far, the formulation containing 2% polyethylene fibers exhibited the greatest durability. Inflator firings were conducted using igniter grains from formulations #3 and #19 with RDC inserted into the 0.15" perforation. Formulation #19 with polyethylene fibers (Allied-Signal, Spectra 900 brand polyethylene fibers) produced the least amount of delay before the gas generant was ignited.

TABLE IV

Igniter Formulations Containing Cyanamer ® A-370 and Selected Fibers.

| Form | % KNO3 | % Boron | % Cyanamer ® A470 | Fiber ID | % Fiber |
|---|---|---|---|---|---|
| 3 | 76.30 | 16.70 | 7.00 | none | 0.00 |
| 16 | 76.70 | 14.30 | 7.00 | Pyrograph ™ III, Carbon | 2.00 |
| 17 | 74.80 | 16.20 | 7.00 | Saffil ®, Type 590, | 2.00 |
| 18 | 74.80 | 16.20 | 7.00 | Nextel ®, ⅛" Ceramic | 2.00 |
| 19 | 77.20 | 13.80 | 7.00 | Allied, Spectra 900, ⅛" | 2.00 |
| 20 | 76.50 | 14.50 | 7.00 | Celanese. ⅛" PBI | 200 |

TABLE V

Test Result Summary For Extruded Igniters Containing Fibers.

| Form | Fiber ID | Igni-tion[2] | Igni-tion[3] | Dura-bility[3] | Coef-ficient |
|---|---|---|---|---|---|
| 3 | none | 2 | 2 | 96 | 39 |
| 3[1] | none, 0.125" ID | 9 | 8 | 101 | 25 |
| 16 | Pyrograph ™ III, Micro | 5 | | 65 | 39 |
| 17 | Saffil ®, Type 590, Micro | 1 | | 107 | 4 |
| 18 | Nextel ®, ⅛" Ceramic | 3 | | 76 | 69 |

TABLE V-continued

Test Result Summary For Extruded Igniters Containing Fibers.

| Form | Fiber ID | Ignition[2] | Ignition[3] | Durability[3] | Coefficient |
|---|---|---|---|---|---|
| 19 | Allied, Spectra 900, ⅛" | 17 | 1 | 357 | 17 |
| 20 | Celanese, ⅛" PBI | 13 | | 126 | 22 |

[1]Formulation 3 with grains having a 0.125" ID instead of the nominal 0.15" ID.
[2]Time required for the flame front on a 7" grain ignited on one end to reach the opposite end. The time is in milliseconds. The data were acquired as described in Example 3.
[3]The same as in footnote 1 but cured epoxy blocking the .15" ID perforation at the opposite end from where ignition was initiated.
[4]Average load at failures of 2" sticks in durability tests. Units are in milli-inch-pounds.

In formulations 16, 17, 18, 19 and 20, respectively, the "fiber ID" can be characterized as carbon fiber, alumina fiber, aluminosilicate, polyethylene, and polybenzimidizole.

Example 4

An extrudable igniter composition was obtained by forming a pre-mix of guar gum (5.0 wt %, 0.25 gram) and water (deionized 15.0 wt %, 1.75 grams); combining the pre-mix with potassium nitrate (average particle size of about 26 microns, 75 wt %, 3.75 grams); and adding thereto fuel, boron (amorphous; 20.0 wt %, 1.00 gram).

Example 5

An extrudable igniter composition was obtained as in Example 4, but 20.0 wt % of water was used.

Example 6

An extrudable igniter composition was prepared as in Example 4, except that the amount of fuel, boron, was increased to 22.0 wt % (1.10 grams) and the amount of binder, guar gum, was reduced to 3.0 wt % (0.15 gram).

Example 7

An extrudable igniter composition was prepared according to the procedure of Example 4, except that the binder was polyacrylamide (Cyanamer "N-300" from Cytec, 5.0 wt %, 0.25 gram).

Example 8

An extrudable igniter mixture is prepared by adding potassium nitrate (210 grams) and a polyacrylamide (14 gram; Cyanamer "N-300" from Cytec) to a bowl; adding water (44.8 grams), to the bowl and mixing for 1 minute; and adding boron (amorphous; 56.0 grams) thereto followed by mixing for about four minutes.

Example 9

An extrudable igniter composition was prepared as in Example 8, except that the amount of water is 50.4 grams, the potassium nitrate and binder are first dry-blended together before adding the water and mixing 1 minute. The powdered boron is then added and the mixing is continued for four minutes.

Example 10

The igniter composition prepared according to Example 8 was granulated, dried and pressed into ½ in diameter by 1 in long pellets. The pellets were then inhibited on all but one face and combusted in a closed pressurized vessel at 1000, 2000 and 3000 psi via ignition of the uninhibited face. Burning rates of 4.16 ips, 4.32 ips and 4.42 ips respectively, were observed.

Example 11

A portion of the wet igniter composition prepared as described in Example 9 was placed in a 2 in diameter ram extruder and forced through an appropriate die so as to provide a center perforated cylindrical extrudate of approx 0.3 in diameter with a perforation diameter of approx 0.06 in. This extrudate was partially dried and cut into 7 in lengths prior to final drying. The resulting igniter sticks were then tested in a gas generating device consisting of a tubular metal cylinder approx 8 in long by approx 2 in diameter closed at both ends and provided with radial ports. One of the end closures was further provided with an initiating squib. The igniter stick was retained in the center of the tube and a 7 in length of rapid deflagration cord (RDC) placed in the center perforation of the stick. The gas generating device was then filled with a charge of gas generant pellets and tested in a closed tank. Comparable results were obtained with the igniter stick in contrast to those obtained with a conventional ignition train in which a perforated metal tube filled with a like quantity of ignition powder and the RDC replaces the igniter stick/RDC combination. In all cases ignition of the gas generant pellets was observed to occur within 8 msec.

Example 12

To a one pint Baker-Perkins planetary mixer, 250.9 g (77.2%) of 35 micron potassium nitrate and 22.75 g (7%) of Cytec Cyanamer® A-370 (90:10 Sodium Polyacrylate/Polyacrylamide: 200,000 MW) were added. These ingredients were then blended remotely in the dry state for one minute. To this blend, 43.8 g (13.5 parts per 100 of igniter formulation) of water were added and the blend was mixed for five minutes. The mix blades and inner surface of the mix bowl were scraped with Velostat (conductive plastic) spatulas. To the resulting thick white paste, 6.5 g (2%) of Spectra 900 brand polyethylene fiber (0.032" dia×0.125" length, Allied-Signal) was added in two parts followed by three minute mix cycles and subsequent scrape downs. To this blend, 44.85 g (13.8%) of amorphous boron powder (90–92% purity) were added in three parts, mixed remotely for three minutes, followed by subsequent scraped down. The blades and bowl were again "scraped down" and the formulation was mixed for ten additional minutes. The resulting brown, dough-like material was granulated to −4 mesh and fed into a Haake 25 mm single-screw extruder. The igniter formulation was extruded through a 12 point star die with a maximum diameter of 0.33" and a minimum diameter of 0.30". The die included a central 0.15" diameter pin. The extruded igniter formulation was cut into 7" and 2" lengths. The igniter sticks were placed on a porous pad and dried at 165 F for 2 hours and then overnight at 200 F. The 7" lengths performed well as igniters in inflators designed for passenger side automotive safety bags.

Durability tests were performed in 3-point bending, with the load applied at mid-span, in the manner described in Example 2. Durability test results indicated significantly enhanced durability of extruded igniter formulations containing the polyethylene fibers, 357 milli-inch-pounds, relative to a comparable formulation without fibers, 96 milli-inch-pounds.

Example 13

To a one gallon Baker-Perkins planetary mixer, 2069.2 g (73.9%) of 20 micron potassium nitrate and 154 g (5.5%) of Cytec Cyanamer® A-370 (90:10 sodium polyacrylate/polyacrylamide: 200,000 Mw) were added. These ingredients were then blended remotely in the dry state for one minute. To this blend, 400 g (12.5% of the complete mix by weight) of water were added and the blend was mixed for five minutes. To the resulting thick white paste, 576.8 g (20.6%) of amorphous boron powder (90–92% purity) were added in three parts, mixed remotely for five minutes followed by subsequent scrape downs. The resulting brown, dough-like material was mixed for an additional 10 minutes. After sitting overnight, the material was forced through a 10 mesh screen in the Stokes granulator. The resulting moist, sticky granules were spread on a 2' wide×3' long×1" deep aluminum pan lined with velostate plastic and placed into a shelf in a "walk-in" oven held at 135° F. The granules were dried for 40 minutes and then regranulated at 10 mesh on the Stokes granulator. The igniter was placed again into the 135° F. oven and dried overnight. The granules were then classified on a Sweco® sieve to −10/+24 mesh. A typical yield of 70% by weight of the −10/+24 mesh granules is achieved.

Example 14

To a one gallon Hobart mixer, 522 g (58%) of 20 micron potassium nitrate and 36 g (4.0%) of Cytec Cyanamer® A-370 (90:10 sodium polyacrylate/polyacrylamide: 200,000 MW) were added. These ingredients were then blended remotely in the dry state for a one minute. To this blend, 107 g of water were added and the blend was mixed for five minutes. To the resulting thick white paste, 203.2 g of a hexaammine cobalt(III) nitrate (HACN)/water slurry (11.5% water in slurry, 20% dry weight of HACN in formulation) were added and mixed remotely for five minutes. 162 g (18%) of amorphous boron powder (90–92% purity) were added in two parts, mixed remotely for five minutes, followed by subsequent scrape downs. The resulting brown, dough-like material was mixed for an additional 5 minutes, 9 grams of water was added, the paste was mixed for 5 more minutes followed by addition of 9 more grams of water. After an additional five minutes of mixing, the formulation had a prilled consistency. The prills were spread on a 2' wide×3' long×1" deep aluminum pan lined with velostate plastic and placed into a shelf in a "walk-in" oven held at 135° F. oven and dried overnight. The prills (granules) were then classifed on a Sweco® sieve to −24/200 mesh.

What we claim is:

1. A supplemental-restraint-system gas generating device for use in a vehicle, said gas generating device comprising:

a sensor for sensing impact to the vehicle and generating an impact signal;

a squib which is operatively associated with the sensor to receive the impact signal from the sensor and which is activated by the impact signal;

an igniter which comprises at least one extruded dry igniter element and is operatively associated with the squib so as to be ignited by the activated squib; and a gas generant composition in operative relation to the igniter so that the igniter, in an ignited state, initiates combustion of the gas generant composition to cause the gas generant composition to generate gas for inflating an air bag, wherein said extruded dry igniter element is formed from an extrudable igniter composition comprising, as ingredients prior to drying of said composition to form said dry igniter element, at least one water-soluble binder dissolved into an aqueous solution, at least one oxidizing agent, at least one fuel, and, optionally, fibers, and wherein said water-soluble binder comprises at least one member selected from the group consisting of a water-soluble polymeric binder, a water-soluble gum present in an amount of from about 2% by weight to about 10% by weight based on the total amount of dry ingredient in said extrudable igniter composition, and water-soluble gelatin.

2. A vehicle equipped with a supplemental safety restraint system having a gas generating device therein, said gas generating device comprising:

a sensor for sensing impact to the vehicle and generating an impact signal;

a squib which is operatively associated with the sensor to receive the impact signal from the sensor and which is activated by the impact signal;

an igniter which comprises at least one extruded dry igniter element and is operatively associated with the squib so as to be ignited by the activated squib; and a gas generant composition in operative relation to the igniter so that the igniter, in an ignited state, initiates combustion of the gas generant composition to cause the gas generant composition to generate gas for inflating an air bag, wherein said extruded dry igniter element is formed from an extrudable igniter composition comprising, as ingredients prior to drying of said composition to form said dry igniter element, at least one water-soluble binder dissolved into an aqueous solution, at least one oxidizing agent, at least one fuel, and, optionally, fibers, and wherein said water-soluble binder comprises at least one member selected from the group consisting of a water-soluble polymeric binder, a water-soluble gum present in an amount of from about 2% by weight to about 10% by weight based on the total amount of dry ingredient in said extrudable igniter composition, and water-soluble gelatin.

3. The device of claim 1, wherein said water-soluble polymeric binder comprises poly-N-vinyl pyrolidone.

4. The device of claim 1, wherein said water-soluble polymeric binder comprises polyvinylalcohol.

5. The device of claim 1, wherein said extrudable igniter composition comprises gum.

6. The device of claim 1, wherein said extrudable igniter composition comprises said water-soluble polymeric binder.

7. The device of claim 1, wherein said water-soluble polymeric binder comprises at least one member selected from the group consisting of polyacrylamide, sodium polyacrylates, and copolymers thereof.

8. The device of claim 1, wherein said oxidizer is present in an amount of from about 40% by weight to about 90% by weight relative to the dry ingredients used in formulating said extrudable igniter composition.

9. The device of claim 1, wherein said oxidizer comprises at least one ionic species selected from the group consisting of nitrate, nitrite, chlorate, perchlorate, peroxides, and superperoxides.

10. The device of claim 1, wherein said extrudable igniter composition contains fibers.

11. The device of claim 10, wherein said fibers comprise at least one of polyolefin fibers, polyamide fibers, polyester fibers, or poly(2,2'-(m-phenylene)-5,5-bisbenzimidazole fibers.

12. The device of claim 1, wherein (a) said binder comprises at least one member selected from the group consisting of poly-N-vinyl pyrolidone, polyvinylalcohol or copolymers thereof, and gum; (b) said oxidizer is present in an amount of from about 40% by weight to about 90% by weight relative to the dry ingredients used in formulating said extrudable igniter composition, and said oxidizer contains at least one ionic species selected from the group consisting of nitrate, nitrite, chlorate, perchlorate, peroxides, and superperoxides; (c) said extrudable igniter composition contains low-aspect ratio fibers, said fibers comprising at least one of polyolefin fibers, polyamide fibers, polyester fibers, or poly(2,2'-(m-phenylene)-5,5-bisbenzimidazole fibers.

13. The device of claim 1, wherein said fuel comprises boron and said oxidizer comprises potassium nitrate.

14. The device of claim 13, wherein said water-soluble polymeric binder comprises at least one member selected from the group consisting of polyacrylamide, sodium polyacrylates, and copolymers thereof.

15. The device of claim 14, wherein said boron is present in an amount of about 5% to about 40% by weight, said potassium nitrate is present in an amount of about 40% to about 90% by weight, and the binder is present in an amount of about 2% to about 10% by weight.

16. The device of claim 14, wherein said extrudable igniter composition further comprises, as one of said ingredients, hexa ammine cobalt nitrate.

17. The device of claim 16, wherein said boron is present in an amount of about 10% to about 20% by weight, said hexa ammine cobalt is present in an amount of about 10% to about 20% by weight, said potassium nitrate is present in an amount of about 40% to about 90% by weight, and the binder is present in an amount of about 3% to about 7% by weight.

18. The device of claim 14, wherein said extrudable igniter composition further comprises, as one of said ingredients, guanidine nitrate.

19. The vehicle of claim 2, wherein said water-soluble polymeric binder comprises poly-N-vinyl pyrolidone.

20. The vehicle of claim 2, wherein said water-soluble polymeric binder comprises polyvinylalcohol.

21. The vehicle of claim 2, wherein said extrudable igniter composition includes gum.

22. The vehicle of claim 2, wherein said extrudable igniter composition comprises said water-soluble polymeric binder.

23. The vehicle of claim 2, wherein said water-soluble polymeric binder comprises at least one member selected from the group consisting of polyacrylamide and copolymers thereof.

24. The vehicle of claim 2, wherein said oxidizer is present in an amount of from about 40% by weight to about 90% by weight relative to the dry ingredients used in formulating said extrudable igniter composition.

25. The vehicle of claim 2, wherein said oxidizer comprises at least one ionic species selected from the group consisting of nitrate, nitrite, chlorate, perchlorate, peroxides, and superperoxides.

26. The vehicle of claim 2, wherein said extrudable igniter composition contains fibers.

27. The vehicle of claim 24, wherein said fibers comprise at least one of polyolefin fibers, polyamide fibers, polyester fibers, or poly(2,2'-(m-phenylene)-5,5-bisbenzimidazole fibers.

28. The vehicle of claim 2, wherein (a) said binder comprises at least one member selected from the group consisting of poly-N-vinyl pyrolidone, polyvinylalcohol or copolymers thereof, and gum; (b) said oxidizer is present in an amount of from about 40% by weight to about 90% by weight relative to the dry ingredients used in formulating said extrudable igniter composition, and said oxidizer contains at least one ionic species selected from the group consisting of nitrate, nitrite, chlorate, perchlorate, peroxides, and superperoxides; (c) said extrudable igniter composition contains low-aspect ratio fibers, said fibers comprising at least one of polyolefin fibers, polyamide fibers, polyester fibers, or poly(2,2'-(m-phenylene)-5,5-bisbenzimidazole fibers.

29. The vehicle of claim 2, wherein said fuel comprises boron and said oxidizer comprises potassium nitrate.

30. The vehicle of claim 29, wherein said water-soluble polymeric binder comprises at least one member selected from the group consisting of polyacrylamide, sodium polyacrylates, and copolymers thereof.

31. The vehicle of claim 30, wherein said boron is present in an amount of about, 5% to about 40% by weight, said potassium nitrate is present in an amount of about 40% to about 90% by weight, and the binder is present in an amount of about 2% to about 10% by weight.

32. The vehicle of claim 30, wherein said extrudable igniter composition further comprises, as one of said ingredients, hexa ammine cobalt nitrate.

33. The vehicle of claim 32, wherein said boron is present in an amount of about 10% to about 20% by weight, said hexa ammine cobalt is present in an amount of about 10% to about 20% by weight, said potassium nitrate is present in an amount of about 40% to about 90% by weight, and the binder is present in an amount of about 3% to about 7% by weight.

34. The vehicle of claim 29, wherein said extrudable igniter composition further comprises, as one of said ingredients, guanidine nitrate.

35. The device of claim 17, wherein said extrudable igniter composition further comprises, as one of said ingredients, guanidine nitrate.

36. The vehicle of claim 33, wherein said extrudable igniter composition further comprises, as one of said ingredients, guanidine nitrate.

* * * * *